United States Patent [19]

Hanson et al.

[11] Patent Number: 5,069,646

[45] Date of Patent: Dec. 3, 1991

[54] TOY SAWABLE WOOD

[75] Inventors: Steven P. Hanson, Orchard Park; Bartley E. Williams, East Aurora, both of N.Y.

[73] Assignee: The Quaker Oats Company, Chicago, Ill.

[21] Appl. No.: 550,398

[22] Filed: Jul. 10, 1990

[51] Int. Cl.[5] ..... A63H 33/04

[52] U.S. Cl. ..... 446/85; 446/86; 446/103; 446/111; 446/122; 446/123; 446/491

[58] Field of Search ..... 446/85, 122, 123, 145, 446/144, 491, 86, 486, 489, 103, 111

[56] References Cited

U.S. PATENT DOCUMENTS 2,703,724 3/1955 Der Yuen et al. ..... 446/123

3,989,251 11/1976 Barlow ..... 446/139 X

FOREIGN PATENT DOCUMENTS 540160 6/1940 United Kingdom ..... 446/123

*Primary Examiner*—Danton D. DeMille

*Assistant Examiner*—Brian E. Hanlon

*Attorney, Agent, or Firm*—Cumpston & Shaw

[57] ABSTRACT

Briefly stated, and in accordance with a presently preferred aspect of this invention, toy sawable wood includes a first simulated wood member; a second simulated wood member releasably attachable to the first simulated wood member for forming a simulated piece of wood; a threaded connecting rod on at least one of the first and second wood members for releasably engaging the other of the first and second wood members to hold the two members together; and a release gear coupled to the connecting rod and responsive to simulated sawing for releasing the first wood member from the second wood member.

6 Claims, 3 Drawing Sheets

TOY SAWABLE WOOD

This invention relates in general to toys and amusement devices, and more particularly to a toy simulated board that can be repeatedly sawn in half and reattached, to simulate sawing a real board.

The demand for new toys is apparently insatiable. Toys that simulate the activities carried on by adults are perenniel favorites. One of the adult activities that is particularly attractive to children is carpentry. Unfortunately, while it is relatively simple to provide plastic carpenter's tools, such as saws and the like, such toys have little play value because they do little more than physically resemble real tools, and they cannot be used for simulating the action of real saws and the like in cutting wooden boards.

The present invention provides a toy simulated board that may be "cut" by a toy saw, and split into two pieces that may be easily reassembled and cut repeatedly.

Briefly stated, and in accordance with a presently preferred aspect of this invention, toy sawable wood includes a first simulated wood member; a second simulated wood member releasably attachable to the first simulated wood member for forming a simulated piece of wood; connecting means on at least one of the first and second wood members for releasably engaging the other of the first and second wood members to hold the two members together; and movable release means coupled to the connecting means and responsive to simulated sawing for releasing the first wood member from the second wood member.

In accordance with another aspect of this invention, the first and second simulated wood members include first and second engaging surfaces, and the connecting means includes reciprocally movable connecting means movable in a direction transverse to the engaging surfaces for releasably connecting the first and second wood members together.

In accordance with still another aspect of this invention, the reciprocally movable connecting means of the toy sawable wood comprises a rod movably mounted in one of the first and second wood members, and having a connecting end extending therefrom and movable into engagement with the second simulated wood member, and an engaging member in the second simulated wood member that engages the connecting end of the rod for releasably holding the members together.

In accordance with still another aspect of this invention, the connecting end is a threaded end and the reciprocally movable rod is rotatably mounted for releasing the first wood member from the second wood member by unscrewing the threaded end.

In accordance with a still further aspect of this invention, a drive wheel is provided on the shaft of the reciprocally movable rod for rotating the shaft to unscrew the threaded end.

In accordance with a still further aspect of this invention, the drive wheel includes a unidirectional ratchet mechanism.

In accordance with another aspect of this invention, the drive wheel comprises a toothed drive wheel, engageable with a toothed simulated saw.

In accordance with a still further aspect of this invention, the directional ratchet drive wheel comprises a generally X-shaped shaft cooperating with first and second generally inwardly extending sickle shaped ratchet fingers on the threaded drive wheel for engaging the shaft in one direction only, and for providing a ratcheting action between the drive wheel and the shaft.

While the novel aspects of the invention are set forth with particularity in the appended claims, the invention itself, together with further objects and advantages thereof, may be more readily comprehended by reference to the following detailed description of a presently preferred embodiment of the invention, taken in connection with the accompanying drawings in which:

Figure 6:
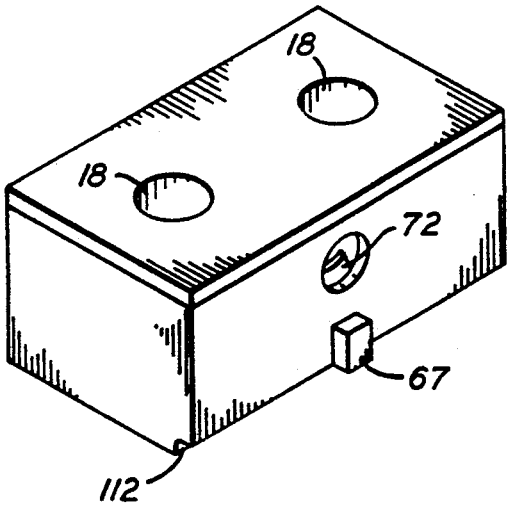

FIG. 6. is a perspective view of one of the sawable wood members; and

Figure 7:
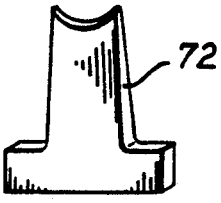

FIG. 7 is a front elevation of the thread engaging clip in accordance with the invention.

Figure 1:
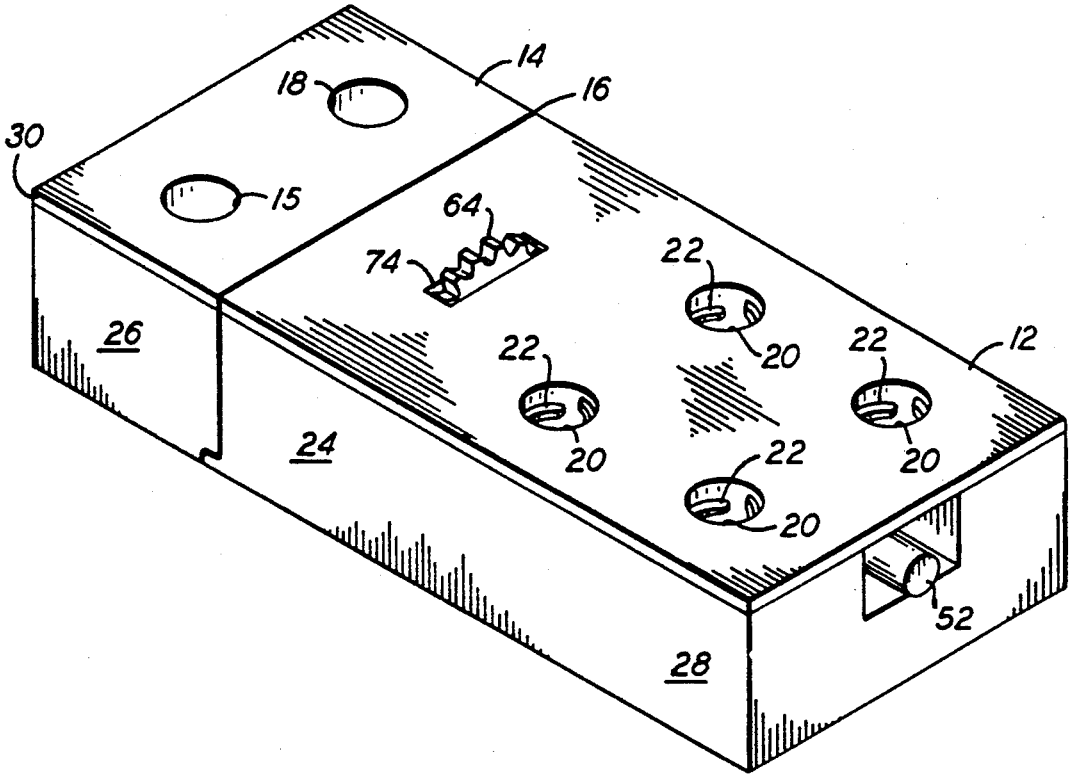
FIG. 1 is a perspective view of toy sawable wood in accordance with the presently preferred embodiment of this invention.

Referring now to FIG. 1, a toy sawable wood board in accordance with this invention is illustrated in a perspective view. The board indicated generally at 10 includes a first simulated wood member 12 releasably connected to a second simulated wood member 14, in a manner to be more fully described below, to form an elongated simulated board 10 that is generally rectangular in cross-section and is adapted to be divided along parting line 16 by a simulated sawing action. Preferably, the board 10 includes a plurality of openings 18 in the second wood member 14, and a plurality of openings 20 in the first simulated wood member 12. As illustrated, some of the openings (18) are through holes, while others (20) are provided with thread engaging projections 22 for engaging the threads of elongated bolts, so that pieces of the toy sawable wood can be fastened together, or fastened to a bench for sawing or the like.

Figure 2:
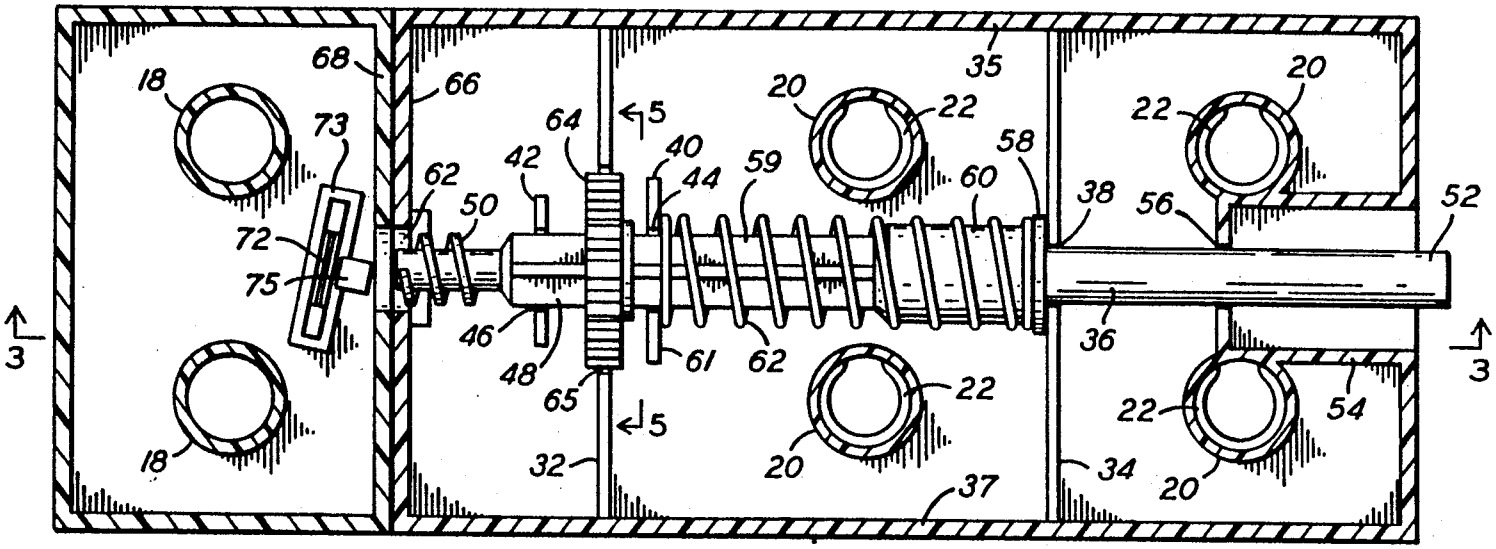
FIG. 2 is a partial section of the toy sawable wood of FIG. 1, showing the internal mechanism.

Preferably, the simulated wood members of toy sawable wood 10 are formed from molded plastic pieces. Each of the first and second simulated wood members includes a base 24, 26 respectively, and a cover 28, 30 respectively attached thereto to form a generally enclosed box. With reference to FIG. 2, it will be observed that the base 24 of simulated wood member 12 is provided with first and second internal reinforcing and supporting webs 32, 34 extending between opposed sidewalls of the base, which sidewalls 35, 37 are connected by first and second end walls. A longitudinally extending rod 36 is supported in a notch 38 formed in web 34, and by internal supporting stanchions 40 and 42 extending upwardly from the base and disposed adjacent to and on either side of web 32. Each of the stanchions is provided with a rounded notch 44, 46 for rotatably supporting an X-shaped portion 48 of a longitudinally extending rod 36. Rod 36 is provided with a coursely threaded end 50 at one end thereof, and a manually operable plunger portion 52 at the other end. A U-shaped indented wall portion 54 of the end wall includes a notch 56 for supporting the plunger portion 52 of rod 36. Rod 36 is thereby rotatably and slidably supported in the first simulated wooden member.

A radial collar 58 and enlarged neck region 60 on the rod 36 engage one end of a spring 62, the other end of which is slidably received over the X-shaped portion 59 of rod 36 also and engages a side surface 61 of stanchion 40. Thus, rod 36 may be moved manually to the left (as shown in FIG. 2) against the force of spring 62, which will return rod 36 to the position illustrated when the force is removed. U-shaped wall section 54 allows plunger portion 52 of the rod to be depressed a sufficient distance so that threaded end 50 extends through an opening 62 in the opposite end wall 66 and some distance out of the first simulated wooden member 12, as may be more clearly seen in FIG. 3. An enlarged gear 64 is slidably disposed on the X-shaped portion 48 of rod 36 and rotatably supported in rounded notch 65 of web 32 for turning the rod, as will be more fully described below.

Figure 3:
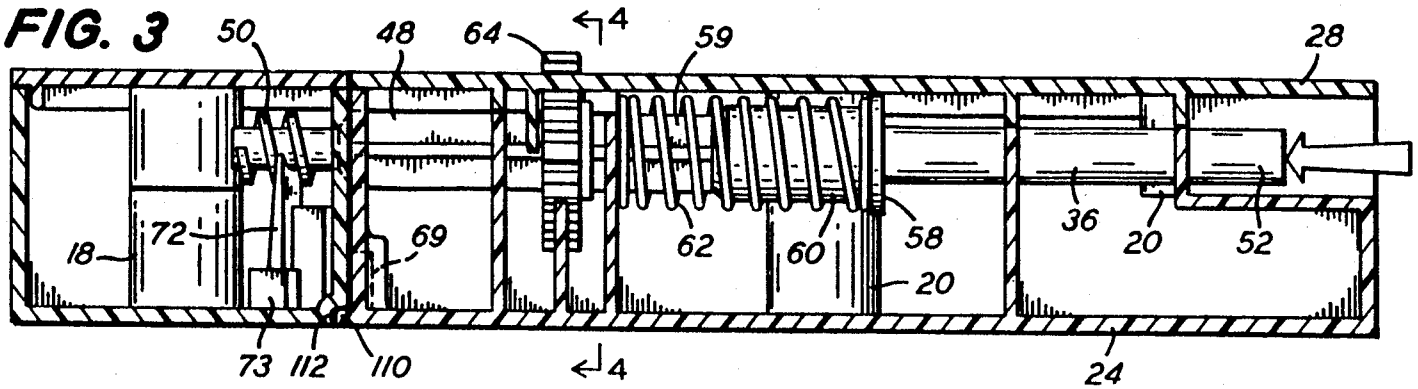
FIG. 3 is a section taken generally along line 3—3 of FIG. 2, but with the top plate in place.

As can be seen in FIG. 2, the first and second simulated wood members 12 and 14 are disposed with their respective end walls 66 and 68 in abutting relationships with opening 70 in wall 68 aligned with opening 62 in wall 66. A projection 67 on member 14 engages a recess 69 (see FIG. 3) in the end wall 66 of member 14. The projection and recess, together with lip 110 and notch 112 as described below, allow the two members to be readily aligned. A tapered resilient thread engaging leaf or finger 72 (see FIG. 7) is disposed in a slot on an upstanding support pedestal 73 within second simulated wood member 14, and aligned with opening 70 for receiving and engaging threaded end 50 of rod 36 as can be best seen in FIG. 3. Finger 72, shown in elevation in FIG. 6, is made from resilient metal or plastic and is adapted to deflect when engaged by threaded portion 50 of rod 36, and to engage the threaded portion as shown in FIG. 3, to hold the simulated wood members securely together. Stop 75, disposed adjacent to finger 72 stiffens finger 72 if the threaded end is withdrawn without unscrewing while allowing the finger to deflect inwardly to permit the threaded end to be inserted without turning, for example by pressing plunger 52.

As can be seen in FIGS. 1 and 3, a portion of gear 64 projects through an opening 74 in cover 28 of simulated wood member 12. The projecting portion of gear 64 may be engaged by a toy simulated saw moved in a normal back and forth sawing motion to rotate gear 64, and unscrew threaded end 50 from thread engaging finger 72. This permits the first and second simulated wood members to separate as if they had truly been sawed in two.

Figure 4:
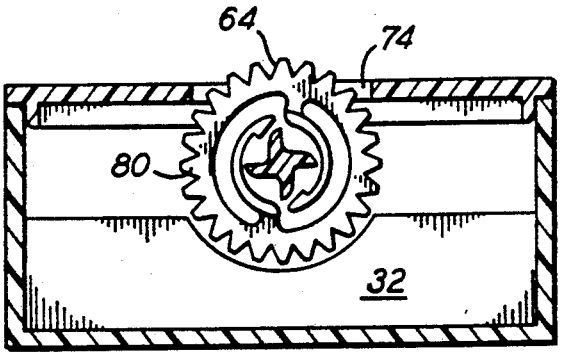
FIG. 4 is a section taken along line 4—4 of FIG. 3.
Figure 5:
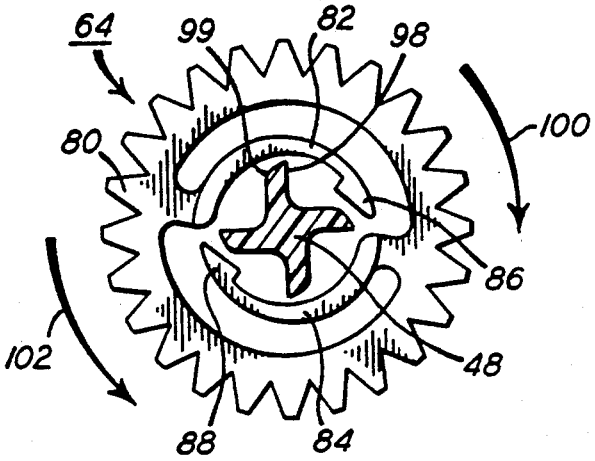
FIG. 5 is an enlarged sectional fragment showing the ratchet mechanism of FIG. 4.

In accordance with a presently preferred embodiment of this invention, as shown in FIGS. 4 and 5, gear 64 includes an annular tubular toothed ring 80 having first and second inwardly extending sickle shaped arcuate ratchet fingers 82 and 84, each extending over slightly less than 180° and terminating in a wedge shaped ratchet ends 86, 88 respectively. A step 90, 92 is formed at the juncture between each of the ratchet ends and the fingers. The X-shaped portion 48 of rod 36 shown in section in FIGS. 4 and 5 has four arms 94, 95, 96 and 97, each terminating in a peripheral end having one sharp corner 98 and a rounded corner 99. The sharp corner 98 preferably includes an angle of about 70° . It will be appreciated that when the gear 64 is rotated in the direction indicated by arrow 100, it will exert a very slight force on rod 36 and tend not to rotate the rod. However, when the gear is turned in the direction of arrow 102, step 92 will engage the sharp corner 98 to rotate the gear 64 in a direction to release the first and second simulated wood members by unscrewing the threaded end of rod 36 from the thread engaging clip.

The toy sawable wood of this invention provides an excellent simulation of actually cutting wood in a manner that can be repeatedly assembled and cut by a child. A variety of toy saws, including hand saws, simulated circulated saws, simulated jig saws and the like, may be employed to engage gear 64 to "cut" the simulated wood into two pieces. The two pieces are easily reassembled by aligning the facing end faces, preferably through the use of lip 110 and notch 112 as shown in FIG. 1, together with projection 67 and recess 69 as shown in FIGS. 3 and 6, and pressing on the plunger portion 52 of rod 36 to engage threaded end portion 50 with thread engaging clip 72. The cutting process may then be repeated.

While the invention has been shown and described in connection with a presently preferred embodiment thereof, those skilled in the art will appreciate that a number of modifications and changes may be made therein, without departing from the true spirit and scope of the invention, which accordingly is intended to be defined solely by the appended claims.

What is claimed is:

1. Toy sawable wood comprising:

a first simulated wood member;

a second simulated wood member releasably attachable to the first simulated wood member for forming a simulated piece of wood;

a reciprocally movable rod rotatably mounted in the first simulated wood member having a threaded connecting end movable into engagement with the second simulated wood member; and means in the second wood member for engaging the threaded connecting end for releasably holding the members together and responsive to simulated sawing for releasing the first wood member from the second wood member.

2. The toy sawable wood of claim 1 in which the first and second simulated wood members comprise first and second engaging surfaces, and the rod is movable in a direction transverse to the surfaces for attaching the first and second wood members together.

3. The toy sawable wood of claim 2 in which the movable release means comprises a drive wheel coupled to said rod for rotating the shaft to unscrew the threaded end.

4. The toy sawable wood of claim 3 in which said drive wheel comprises a unidirectional drive drive wheel.

5. The toy sawable wood of claim 3 in which said drive wheel comprises a toothed drive wheel.

6. The toy sawable wood of claim 5 in which the rod comprises a shaft having a generally X-shaped cross section, and in which the drive wheel comprises first and second generally inwardly extending sickle shaped ratchet fingers for drivingly engaging the shaft in one direction only, for providing a ratcheting action between the drive wheel and the shaft.

* * * * *